US006068356A

United States Patent [19]

Giuseppe

[11] Patent Number: 6,068,356

[45] Date of Patent: May 30, 2000

[54] MULTIPURPOSE FOOD SERVICE TROLLEY

[76] Inventor: Galtieri Giuseppe, Via Ducezio, 36 Park Palace, Messina 98100, Italy

[21] Appl. No.: 09/201,890

[22] Filed: Nov. 30, 1998

[30] Foreign Application Priority Data

Nov. 28, 1997 [IT] Italy ..... RM970259 U

[51] Int. Cl.[7] ..... A47B 81/00

[52] U.S. Cl. ..... 312/290; 312/249.11; 312/324; 280/47.35

[58] Field of Search ..... 312/249.8, 249.11, 312/249.1, 291, 283, 287, 289, 290, 236, 324; 280/47.34, 47.35, 79.3; 296/26.09, 26.13

[56] References Cited

U.S. PATENT DOCUMENTS

| | | | |
|---|---|---|---|
| 1,524,249 | 1/1925 | Jarvis et al. | 312/290 X |
| 1,547,846 | 7/1925 | Tonnesen | 312/249.8 |
| 2,058,682 | 10/1936 | Green | 312/290 X |
| 2,531,444 | 11/1950 | Lane | 312/290 X |
| 3,275,393 | 9/1966 | Stentz et al. | 312/236 X |
| 3,297,375 | 1/1967 | Reeves | 312/283 X |
| 3,472,392 | 10/1969 | Hahn | 280/47.35 |
| 3,531,169 | 9/1970 | Hoffmann et al. | 312/236 |
| 3,591,015 | 7/1971 | D'Anka | 312/236 X |
| 5,174,468 | 12/1992 | Holderman . | |
| 5,651,597 | 7/1997 | Oslin | 312/410 X |

FOREIGN PATENT DOCUMENTS

| | | | |
|---|---|---|---|
| 330197 | of 0000 | France | 312/290 |
| 319288 | 11/1902 | France | 312/290 |
| 7183 | 5/1886 | United Kingdom | 312/311 |

*Primary Examiner*—Peter M. Cuomo
*Assistant Examiner*—Hanh V. Tran
*Attorney, Agent, or Firm*—Browdy and Neimark

[57] ABSTRACT

A multipurpose food service trolley has a parallelepiped cabinet with closed lateral walls, end doors, a pair of support surfaces on its upper face, separated by a central opening, two sliding bottoms; and internally, a prismatic container, open at the top, provided in the central opening to divide the interior of the cabinet in two chambers. In the chambers, multiple sliding support elements, in the form of glass holders or shelves, bear on a support frame manually translatable to disappear in the respective lateral wall.

9 Claims, 3 Drawing Sheets

FIG. 6
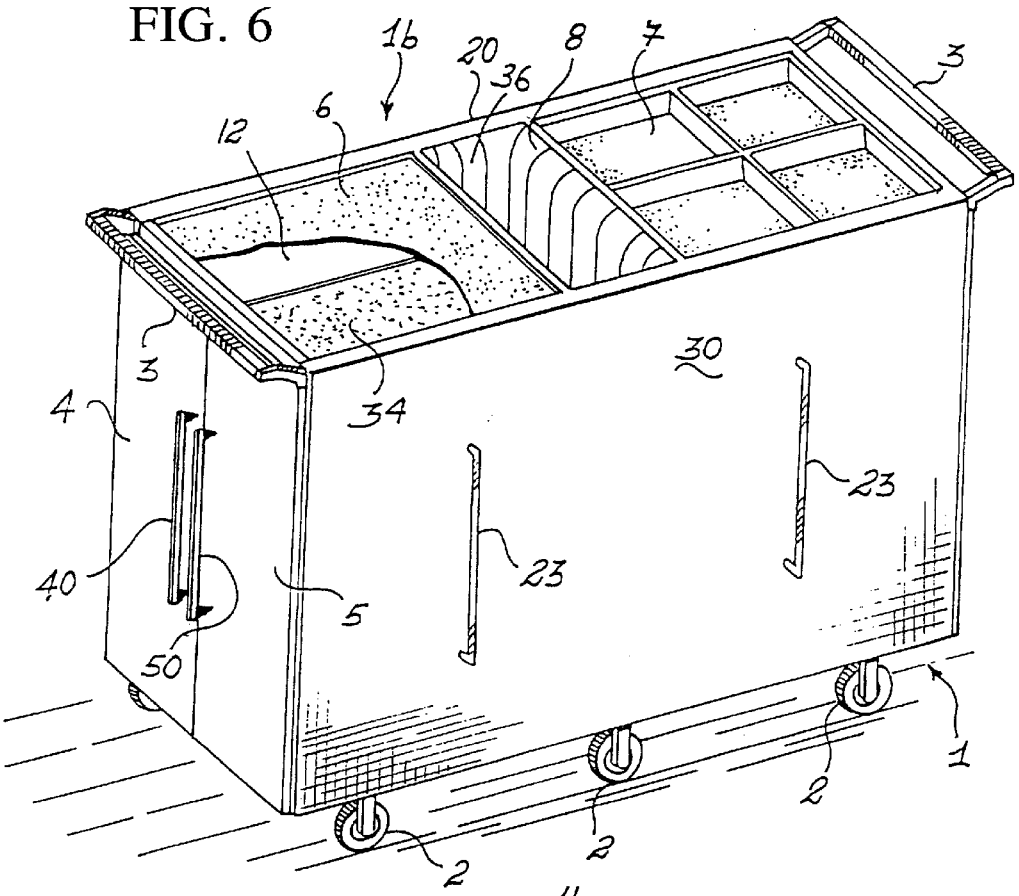
FIG. 8
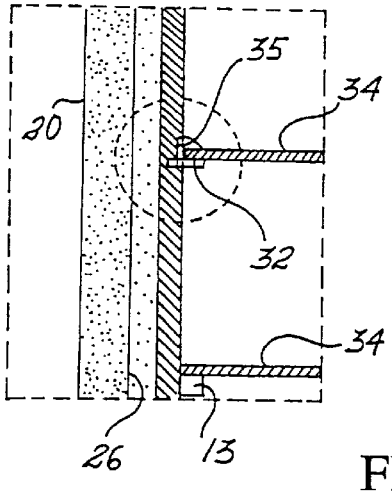
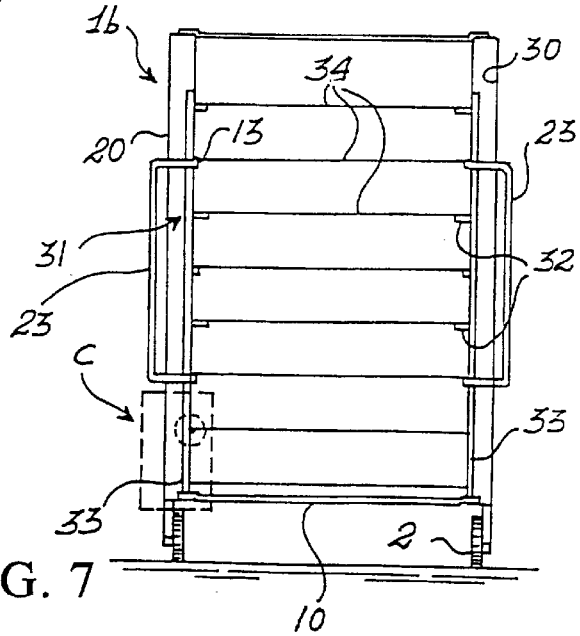
FIG. 7

MULTIPURPOSE FOOD SERVICE TROLLEY

BACKGROUND OF THE INVENTION

The present invention relates to a multipurpose food service trolley, usable, in general, to set and clear tables for many guests and with numerous crockery items, in particular with glasses of multiple shapes, for each place.

Current trolleys have very limited capacities, simply allowing, for instance in clearing tables, the glasses to be set down, with their residual liquids, on their shelves. Since they are simply set down, the glasses run the risk of hitting each other or of being upset as the trolley is moved, with the frequent possibility of breaking.

The reduced capacity of current trolleys forces to increase their number, as well as that of personnel dedicated thereto, with the consequent increase in costs.

The object of the present invention therefore is to eliminate the aforementioned drawbacks.

SUMMARY OF THE INVENTION

The invention, as it is characterized by the claims that follow, solves the problem of providing a multipurpose food service trolley, of the type with a parallelepiped cabinet mounted on wheels and provided at its front and rear with guide handle which, from a general point of view, is wherein said cabinet comprises:

closed lateral walls;

end doors;

a pair of support surfaces on its top face, separated by a central opening;

a pair of sliding bottoms; and internally, a prismatic container, whose height equals that of said cabinet, open at its top and provided at the bottom with a tap for the discharge of liquids, provided in said central opening to divide the interior of the cabinet in two chambers;

multiple sliding support elements in each of said two chambers, presenting on the inner side of each lateral wall a supporting frame with multiple levels for said sliding support elements, which is manually translatable to disappear within an opposite cavity of the respective lateral wall.

BRIEF DESCRIPTION OF THE DRAWINGS

Further features and advantages of the present invention will become more readily apparent from the detailed description that follows, of a preferred embodiment shown purely by way of non-limiting indication in the accompanying drawings wherein:

FIG. 6 shows an axonometric view of a multipurpose trolley according to the invention, equipped for the transport of dishes and utensils, FIG. 7 shows the trolley of FIG. 6 in a vertical section, FIG. 8 shows in enlarged scale the detail indicated as C in FIG. 7.

DESCRIPTION OF THE PREFERRED EMBODIMENTS

Figure 1:
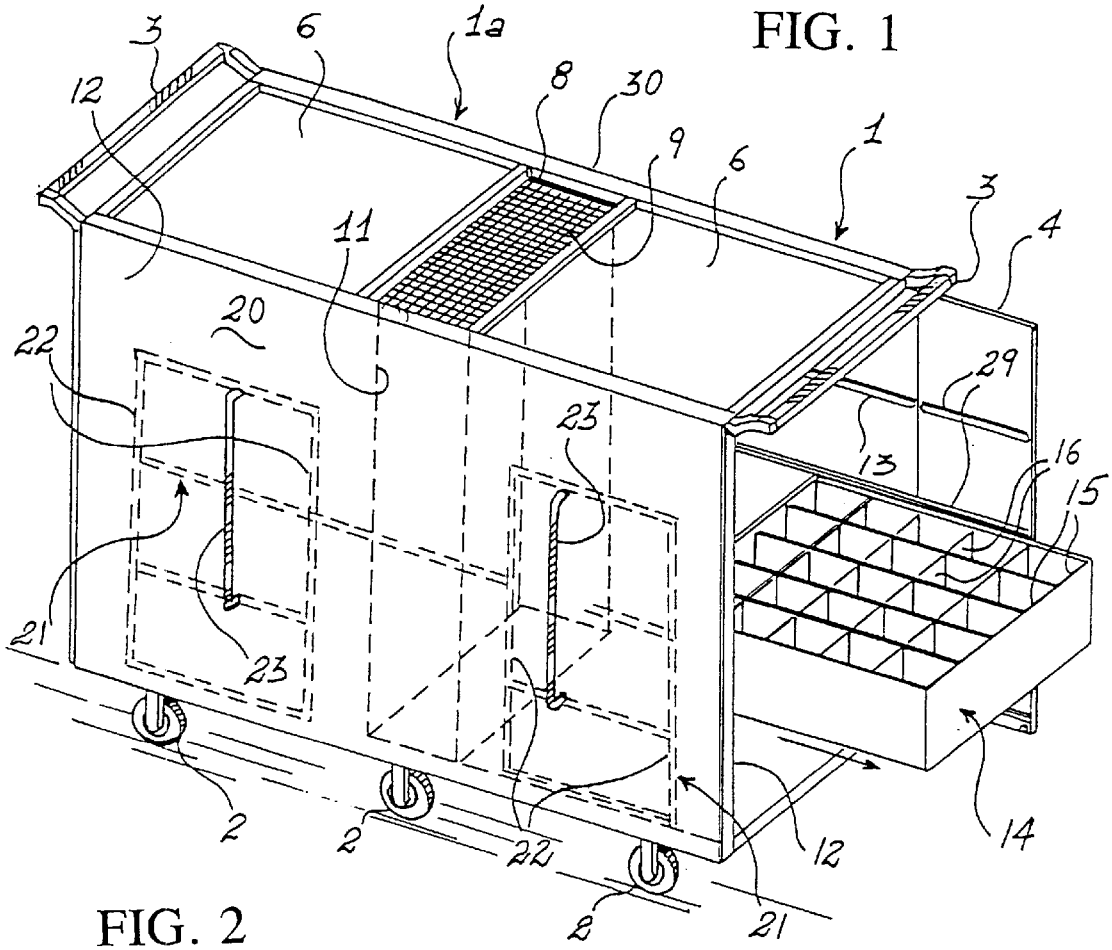
FIG. 1 shows an axonometric view of a multipurpose trolley according to the invention, equipped for transporting glasses.

In accordance with the present invention, in the figures the numbers 1*a*, 1*b* indicate in its entirety a multipurpose trolley equipped for the transport of glasses and, respectively, of other types of crockery, as well as of antipasto dishes. The same numbers are used in all figures to indicate identical or similar parts.

The multipurpose trolley 1*a*, 1*b* (FIGS. 1, 6) comprises a parallelepiped cabinet mounted on wheels 2 and provided at its front and rear with a guide handle 3. The wheels 2 can be in the number of six as shown, possibly pivoting, or in the number of four, of larger diameter than those shown, depending on the ground whereon the trolley is destined to be used.

The cabinet 1 of the trolley 1*a*, 1*b* externally comprises closed lateral walls 20, 30, end doors 4, 5, respective with handles 40, 50, a pair of support surfaces 6, 6, and 6, 7 on its top face, separated by a central opening 8 which can be covered by a grid 9 (FIGS. 1, 2), a pair of sliding bottoms 10.

Internally, the cabinet 1 of the trolley 1*a*, 1*b* presents a prismatic container 11, whose height is equal to the height of the cabinet 1. The prismatic container 11, open at the top and provided at the bottom with a tap for the discharge of liquids (not shown), is provided in the central opening 8 and it divides the interior of the cabinet in two chambers 12, 12. On the inner side of the lateral walls of each of the two chambers 12, 12, are present horizontal strips 13, comprised in a support frame 21 with multiple levels for sliding support elements, which shall be illustrated in greater detail hereafter.

Figure 2:
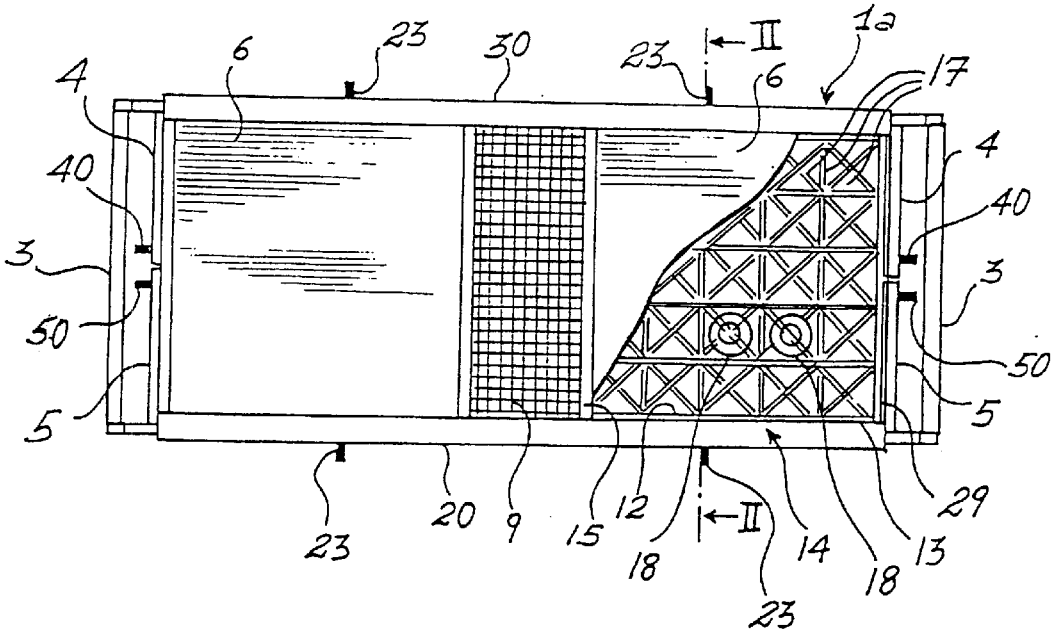
FIG. 2 shows a plan top view, partially sectioned, of the trolley of FIG. 1.

With reference in particular to FIGS. 1 through 5, in each of the two chambers 12, 12 of the trolley 1*a* are present, as sliding elements, glass holders 14, i.e. a flattened box, provided with compartments indicated generically as 15. As shown in FIGS. 1 and 2, each compartment 15, open at the top, has vertical walls 16, a through bottom provided with ribs 17, for instance diagonal, and able to serve as supports for a glass, for instance a chalice 18, placed upside down therein. Preferably the glass holders 14 have such dimensions as to be loaded in a dishwasher.

The support frame 21 with multiple levels for the glass holders 14 is such as to be translatable manually to disappear within an opposite cavity of the respective lateral wall.

Figure 3:
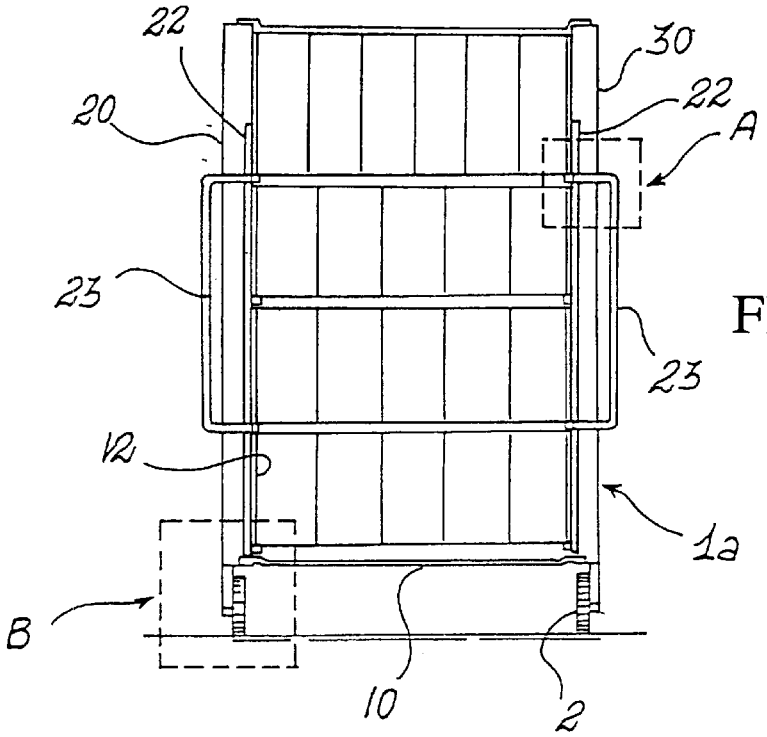
FIG. 3 shows the trolley in a vertical section obtained along the line II—II of FIG. 2.
Figure 4:
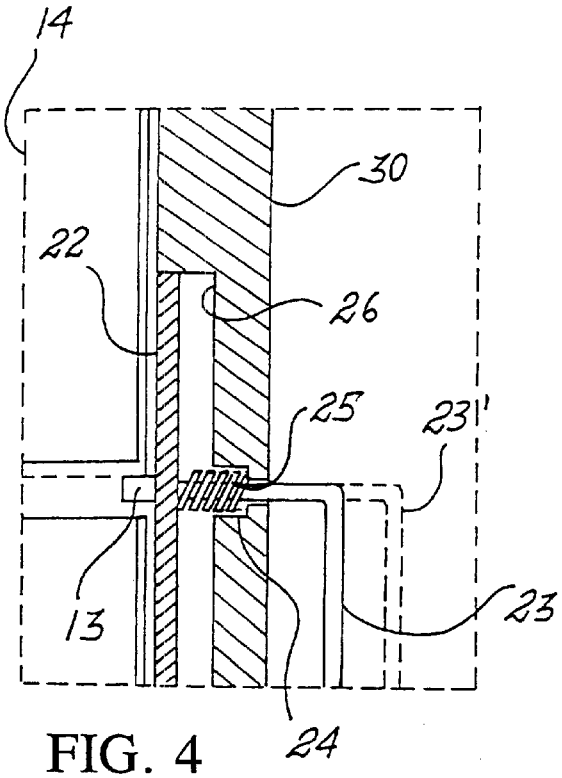
FIG. 4 shows in enlarged scale the detail indicated as A in FIG. 3.
Figure 5:
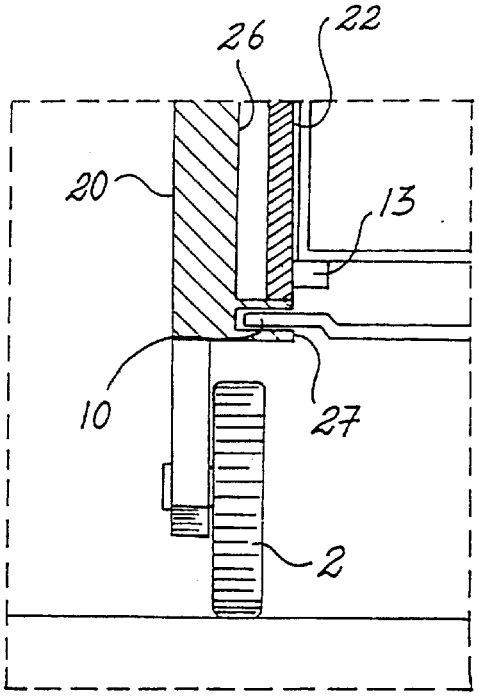
FIG. 5 shows in enlarged scale the detail indicated as B in FIG. 3.

In particular, with reference also to FIGS. 3 and 4, the support frame 21 comprises a plurality of horizontal strips 13, fastened onto vertical uprights 22. The frame 21, so constructed, is connected by means of crosspieces (not shown) to a related large handle 23. As shown in FIG. 4, the large handle 23 passes through the lateral wall 20 (or 30) with a pair of holes 24. Each hole 24 (FIG. 4) has a length of larger diameter to receive a helical spring 25 operating by compression, secured between the upright 22 and the lateral wall 20 (or 30). the upright 22 is located inside a cavity 26 of the wall 20 (30). The cavity 26 has such thickness as to allow, by pulling the handle 23 outward, in the position 23' drawn with dashed line in FIG. 4, the translation of the entire frame 21 from a stable position wherein the horizontal strips 13 project inwards from the lateral wall 20 to an unstable position wherein the strips 13 are flush with this wall. In this unstable position, the glass holders 14 are simultaneously deprived of the lateral support and, due to gravity, they will move downwards, until they become stacked on a service trolley of a type known in the art positioned under the chamber 12 of the cabinet 1 and they will be removed longitudinally from the chamber 12 itself. The operation is repeated exactly for the other chamber 12.

For stacking the glass holders 14 outside the cabinet 1 of the trolley 1*a* it is necessary first to extract the bottom 10, able to slide in its prismatic guide 27 (FIG. 5) serving as a tray for the possible collection of the dripping of the residual liquid from the glasses 18 stowed in the glass holder 14. Most of the residual liquid will have been poured by assigned personnel into the prismatic container 11, on whose grid the glasses 18 can be set upside down for an initial dripping. The support surfaces 6, 6 adjacent to the central opening 8 can be removed to allow a possible loading from above of the glass holders 14 already positioned inside the chamber 12.

Otherwise, the glass holders 14 can be made to exit from the chamber 12, sliding on strips 29, coplanar to the horizontal strips 13 of the lateral walls 20, 30 and provided on the inner side of the end doors 4, 5. The doors can be opened from their closed position, as shown in FIG. 2, to a position of maximum opening (FIG. 1) wherein they are coplanar to the lateral walls 20, 30. In FIG. 1, for the sake of clarity, an end door has been removed.

The numerous advantages of the trolley 1*a*, used to transport glasses, are evident. In the first place, the rational transport of a high number of glasses for each run, together with other accessories such as ashtrays, candle holders, etc., placed on the upper support surfaces; and, above all, the greater gentleness made possible in handling, with a consequent lower probability of breaking the glasses. This also derives from a lower number of passages since the glasses, thanks to the dishwasher-compatible holders, are transported directly from the washing compartment to the dining room tables for setting, and vice versa, during the clearing phase. The trolley 1*a* lets the number of assigned personnel decrease and allows table-setting operations that are cleaner and more decorous in the eyes of the guests.

Thanks to the use of wheels of a suitable type, the trolley 1*a* is employable on any type of ground, in addition to the normal floor, such as gravel, English-style lawn, paved ground with grooves between tiles, etc.; it allows to overcome inclines, obtained with ramps, currently more and more common for overcoming the so-called architectural barriers. To prevent the end doors 4, 5, from opening accidentally, it is sufficient to insert between them and the lateral walls of the trolley known locking devices or devices providing adequate resistance to the opening of the doors. The use of the large handles commanding the support frame allows considerably to quicken the off-loading operations of the empty and full glass holders, and hence a further decrease in the costs of the service.

With reference to FIGS. 6 through 8, a trolley 1*b* similar to the trolley 1*a* is shown, wherein the cabinet 1 is equipped in particular for handling crockery other than glasses. In each of the two chambers 12, 12 of the trolley are present, as sliding elements, support shelves 34. The related support frame 31 is substantially identical to the frame 21, with the difference that in the frame 31, as shown in FIGS. 7 and 8, the number of usable shelves was increased by means of horizontal strips 32 mounted, on the uprights 33, by means of hinges and hence able to rotate to disappear within an opposite cavity 35 of the respective lateral wall 20, 30. This allows to stow plates with antipastos, for a quicker distribution.

As shown in FIG. 6 the prismatic container 11 with its opening 9 can be used to house a waterproof bag 36 for the collection of the residues of the plates, whilst the tray 7 is appropriately provided with compartments for the differentiated placement of utensils, both during the setting up phase and subsequent to their use.

It is understood, without adding further details on the different possibilities of utilization, that the tray 1*a*, 1*b*, with its different equipment, in accordance with the present invention, substantially meets all transport requirements entailed in the food service industry, to aid table service. Additional advantages, beside those already mentioned, are represented by a quicker service to the customers, lesser work for dining hall personnel, who have to travel over shorter distances; better service, thanks to the more assiduous presence of personnel at the tables, available to customers, since only the waiter assigned to the trolley will leave therewith to empty it of the dirty dishes and of the utensils; thanks to the positioning on the trolley of the dishes already cleared of residues and to the subdivision of the utensils directly in the dining hall, lesser work for personnel of the washing department, since the dishes and the utensils arrive already separated, the glasses ready in their holders; a smaller number of waiters with respect to traditional services; fewer personnel assigned to washing and selecting clean utensils; fewer causes for glass breakage; considerable savings on utensils, which, in the traditional system whereby the dishes are cleared of residue in the washing department, often end in the rubbish bin; great convenience in open air service structures; elegance and decor of use.

The invention thus conceived may be subject to numerous modifications and variations, without thereby departing from the scope of the same innovative concept. Moreover, all components may be replaced with technically equivalent elements.

In practice, modifications and/or enhancements are obviously possible without thereby departing from the scope of the claims that follow.

What is claimed:

1. A multipurpose food service trolley, of the type with parallelepid cabinet with closed lateral walls, end doors and a pair of support surfaces on its upper face separated by a central opening, mounted on wheels and provided at the front and at the rear end with guide handle, wherein said cabinet comprises:

a pair of sliding bottoms; and internally, a prismatic container, whose height equals that of said cabinet, open at the top, provided in said central opening to divide the interior of the cabinet in two chambers;

multiple sliding support elements in each of said chambers, presenting, on the inner side of each lateral wall, a support frame with multiple levels for said sliding support elements; wherein said support frame comprises a plurality of first horizontal strips, fastened on at least one vertical upright, and a large handle, passing through said lateral wall and loaded elastically by at least a pair of compression-operated springs fastened between said at least one upright and said lateral wall, for manual translation of said sliding support elements to a location within an opposite cavity of the respective lateral wall, between a position wherein said strips project inwards from said lateral wall and a position wherein they are flush with said wall.

2. A trolley according to claim 1, wherein second strips, coplanar to said first horizontal strips, are provided on the inner side of said end doors, openable from their closed position to their open position coplanar to said lateral walls.

3. A trolley according to claim 1, wherein said prismatic container is closed at the top with a grid.

4. A trolley according to claim 1, wherein said sliding support elements are glass holders.

5. A trolley according to claim 4, wherein said glass holders are so dimensioned as to be loaded in a dishwasher.

6. A trolley according to claim 1, wherein said sliding support elements are support shelves.

7. A trolley according to claim 1, wherein each of said sliding support bottoms is constituted by a tray for the collection of any dripping of residual liquids.

8. A trolley according to claim 1, wherein at least one surface of said pair of support surfaces on its upper face is divided into compartments to receive utensils.

9. A multipurpose food service trolley mounted on wheels and provided at a front end and a rear end thereof with guide handles, wherein said cabinet comprises:

closed lateral walls;

end doors;

a pair of support surfaces on its upper face, separated by a central opening;

a pair of sliding bottoms;

and internally, a prismatic container having a height equal to that of said cabinet, open at the top and provided in said central opening to divide the interior of the cabinet in two chambers;

multiple sliding support elements in each of said chambers, presenting, on the inner side of each lateral wall, a support frame with multiple levels for said sliding support elements, which can be manually slid to disappear within an opposite cavity of the respective lateral wall, wherein said support frame comprises a plurality of horizontal strips, fastened on at least one vertical upright, and a large handle, passing through said lateral wall and loaded elastically by means at least of a pair of compression-operated springs, fastened between said at least one upright and said lateral wall, for a manual translation between a position wherein said strips project inwards from said lateral wall and a position wherein they are flush with said wall.

* * * * *